United States Patent [19]

Pedersen et al.

[11] 4,389,153

[45] Jun. 21, 1983

[54] BACKHOE SWING MECHANISM

[75] Inventors: Carl O. Pedersen; Herman J. Maurer, both of Burlington, Iowa

[73] Assignee: J. I. Case Company, Racine, Wis.

[21] Appl. No.: 329,348

[22] Filed: Dec. 10, 1981

[51] Int. Cl.[3] ..... E02F 3/32; F15B 15/04

[52] U.S. Cl. ..... 414/695.5; 91/176; 91/417 R; 414/687

[58] Field of Search ..... 414/687, 694, 744 R, 414/695.5; 91/176, 188, 210, 417 R

[56] References Cited

U.S. PATENT DOCUMENTS

| | | | |
|---|---|---|---|
| 3,047,171 | 7/1962 | Long | 414/744 R X |
| 3,407,946 | 10/1968 | Pilch | 414/695.5 |
| 3,530,766 | 9/1970 | Pilch | 414/695.5 |
| 3,630,120 | 12/1971 | Carlson et al. | 414/694 X |
| 3,757,642 | 9/1973 | Schuermann | 91/176 |
| 3,872,985 | 3/1975 | Short | 414/694 |
| 4,085,855 | 4/1978 | Worback | 414/694 |
| 4,138,928 | 2/1979 | Pilch | 414/694 X |
| 4,341,501 | 7/1982 | Maurer et al. | 414/694 |

*Primary Examiner*—Robert J. Spar
*Assistant Examiner*—Terrance L. Siemens
*Attorney, Agent, or Firm*—Dressler, Goldsmith, Shore, Sutker & Milnamow, Ltd.

[57] ABSTRACT

An improved hydraulic system is disclosed for a backhoe having a rotating boom operated by a hydraulic swing mechanism. The system includes a hydraulic rotary sequencing valve which is operatively connected with the swing tower which supports the rotating boom. During rotation of the swing tower and boom by the hydraulic motors of the backhoe, the rotary valve is operated to selectively direct pressurized fluid to the motors for improved torque characteristics. A hydraulic cushioning circuit is provided in association with the rotary sequencing valve so that hydraulic cushioning of the motors, and thus the boom, is effected during the approach of the boom toward its travel stops, eliminating the need for conventional cushioning mechanisms in the motors themselves, and improving overall performance of the machine.

17 Claims, 10 Drawing Figures

12
22
20
16
14
92
10
18
24
26

14
92
96
18
26
24
98
46
48
64
66
80
94
50
74
44
P
40
42

45°
14
18
0°
34
32
30
14
26
28
38
24
36
10

135°
45°
34
14
18
14
32
30
26
28
38
24
36
10

135°
14
32
180°
18
34
28
14
30
24
26
38
36
10

18
0°
14
26
24
70
68
58
70
48
46
56
84
60
66
64
54
88
84
90
86
82
53
84
80
52
50
78
62
72
77
76
74
48
46
44

BACKHOE SWING MECHANISM

CROSS-REFERENCE TO RELATED APPLICATIONS

The present invention is related to Ser. No. 180,311, filed Aug. 22, 1980, now U.S. Pat. No. 4,341,501, Ser. No. 300,183, filed Sept. 8, 1981, and Ser. No. 329,349, filed Dec. 10, 1981.

TECHNICAL FIELD

This invention relates generally to material handling and excavation equipment, and more particularly to an improved hydraulic valving arrangement for the hydraulic boom swinging mechanism of a backhoe.

BACKGROUND OF THE INVENTION

A conventional backhoe includes an articulated boom mounted on the rear of a tractor or similar piece of equipment which carries a pivotal bucket for digging operations. The boom is mounted to a swing tower for movement about a vertical axis so that material carried by the backhoe bucket may be moved from one area to another. The swing tower is rotated from side to side by opposed double acting hydraulic motors controlled by a directional control valve manipulated by the backhoe operator.

Backhoes are employed for a wide variety of material handling and excavation operations, and as a result the business is highly competitive in nature. In view of this, any means whereby the work can be more efficiently performed is desirable. One of the ways in which efficiency may be increased is to shorten the time cycle involved in filling the bucket, raising it out of the excavation, swinging the bucket laterally, depositing the material within the bucket on a pile or into a truck, and then returning the bucket to repeat the cycle.

With conventional hydraulic arrangements employed prior to the 1960's for rotating the swing tower of the backhoe, it was the usual practice of operators, in order to save time, to swing the boom and swing tower over hard against the mechanical travel or swing stops provided on the backhoe frame for limiting the arc of swinging movement. This practice was found to be very detrimental because the frame, the swing tower and boom, and the hydraulic circuits were subjected to severe shock loading. While these shocks could be minimized by careful manipulation of the backhoe swing controls, this extra degree of care proved to be time consuming, and thus decreased productivity.

Thus, in order to alleviate this problem while improving the productivity and efficiency of the backhoe, various systems have been devised to decelerate the boom and swing tower prior to hitting the swing stops, even if the backhoe operator does not attempt to reduce the speed of the boom.

One prior method of cushioning movement of the boom and swing tower as they approach the stops at the end of the arc of travel includes substantially blocking the normal flow port from the cylinder end of each of the hydraulic motors to restrict fluid flow. Flow is blocked by a projection carried by the piston of each of the hydraulic motors that enters and substantially blocks flow in a motor outlet port as the piston moves within the motor. Projections such as these are sometimes referred to as "stingers." Although such arrangements are still commonly in use today, their fabrication and maintenance has proven to be relatively expensive.

Another arrangement for providing cushioning for the movement of the boom and swing tower is to include an orifice in the outlet port of the hydraulic motors. In this way, back pressure is created within the hydraulic motors which acts to resist the continued swinging movement of the boom and swing tower. This arrangement is not without its drawbacks, however. The pressure generated by the orifice is continually resisting the swinging movement of the boom and swing tower, even when the backhoe operator is trying to accelerate the swinging movement. This acts to lower the speed of the swinging movement, uses more energy than is necessary to swing the boom, and generates more heat in the hydraulic system. Further, the use of such orifices does nothing to slow or cushion the swing of the boom and swing tower toward the extreme ends of the arc of travel because the fluid flow through the orifices is too small to generate sufficient pressure to slow the swinging movement. In view of this, use of orifices in combination with the above-described stingers is not uncommon, but such arrangements are fairly expensive and may be subject to problems during field use.

Another area of backhoe swing mechanism design which has created problems relates to the positioning and hydraulic porting of the hydraulic motors. Part of the versatility of backhoes is derived from their ability to rotate the swing tower and boom through an arc of approximately 180 degrees. Although various arrangements have been tried, spacial limitations have generally required that the hydraulic motors be mounted on the backhoe frame generally parallel to each other and on respective sides of the vertical axis of the swing tower. It will be appreciated, however, that this arrangement creates problems when the swing tower is rotated through the desired arc of travel.

Specifically, as the swing tower and boom rotate in one direction or another, from a centrally disposed position, one of the hydraulic motors extends to a fully extended condition which occurs as the centerline of that motor intersects the vertical axis of the swing tower. When this occurs, the motor is frequently referred to as being in its "center" position. As the swing tower continues to rotate toward the travel stop, that motor would start to contract, and would be referred to as being in an "overcenter" position or condition. If the supply of pressurized hydraulic fluid to the hydraulic motors is continued and ported without change as one of the motors goes overcenter, the pressure of the fluid causes that motor to exert a "negative torque" on the swing tower and boom. Becaue of the geometry of the swing tower and the hydraulic motors, the hydraulic motor which has gone overcenter acts upon the swing tower through a lesser moment arm than the other hydraulic motor of the swing mechanism. Consequently, the swing tower continues to move as intended, with the one motor not only rotating the swing tower and boom, but working to overcome the negative torque created by the overcenter hydraulic motor. Thus, a swing mechanism control system which operates to eliminate the negative torque created by one of the hydraulic motors in an overcenter configuration as the swing tower and boom are moved provides a more efficient swing mechanism system.

It is particularly desirable to eliminate this negative torque exerted by the overcenter motor as the swing tower and boom are moved away from their travel stop. This improves the net torque applied to the boom assembly. Further benefit is desired if the overcenter motor can be ported to provide a supplemental torque to the boom assembly which assists the motor providing the primary torque in initiating swinging movement of the mechanism.

Thus, a hydraulic valving arrangement for a swinging mechanism of a backhoe which acts not only to alleviate the problems of cushioning the boom and swing tower assembly, but also improves the operational characteristics of the assembly, particularly toward the ends of its arc of travel (when one of the hydraulic motors is in an overcenter position), would be extremely desirable.

SUMMARY OF THE INVENTION

The present invention provides a novel valving arrangement and operating mechanism for the swing mechanism of a backhoe which performs both cushioning and sequencing functions during swinging movement of the boom. Particularly, hydraulic cushioning is effected as the boom is moved through the end portions of its arc of travel prior to reaching the ends of the arc, while relatively unrestricted movement of the boom is possible when hydraulically restricted movement is not desirable. It will be understood that while the present invention is described in association with a backhoe, it would be equally suitable for use in a like application where a pivotally movable member is rotated relative to a fixed member through an arc by the conversion of rectilinear motion to rotational motion, and where the operational characteristics provided by the present invention are desired.

Specifically, and with reference to application in a backhoe, two hydraulic motors are used to rotate the swing tower which supports the boom of the backhoe for swinging movement about a vertical pivot axis. The swing tower is pivoted about the vertical axis on a backhoe support stand or frame, which in turn is typically attached to a tractor. Each of the hydraulic motors is pivotally interconnected between the frame and the swing tower. The hydraulic system of the tractor supplies fluid under pressure to actuate the hydraulic motors. A directional flow control valve, which is manipulated by the operator of the backhoe, directs fluid under pressure to the hydraulic motors in order to rotate the swing tower with respect to the frame. The position of the flow control valve determines the direction of the pressurized hydraulic fluid to the hydraulic motors for selective swinging movement of the boom and swing tower.

In accordance with the present invention, a rotary sequencing valve and hydraulic cushioning circuit are hydraulically joined with an end of each of the two hydraulic motors and the flow control valve. The rotary sequencing valve includes a housing body having a bore and a rotatable valve spool disposed within the bore. The position of the valve spool within the valve housing is altered by a sequencing control mechanism having a simplified construction which operatively associates the rotary valve with the swing tower of the backhoe. In this way, the position of the valve spool is a function of the position of the swing tower and boom relative to the frame of the backhoe.

The valve spool is rotatably repositioned within the valve body of the sequencing valve concurrently and proportionally with the rotating swing tower and boom of the backhoe. This permits selective redirection of hydraulic fluid to the hydraulic motors at desired points in the arc of travel of the swing tower and boom. In view of the physical arrangement of the hydraulic motors with respect to the backhoe frame and swing tower, it is desirable that hydraulic fluid supplied to the hydraulic motors be redirected generally as either of the motors moves into or out of its overcenter configuration. The sequencing mechanism and the rotary sequencing valve provide this result, and enable hydraulic fluid to be directed by the valve for improved operational characteristics of the hydraulic motors as the swing tower is moved about its vertical axis.

The rotary sequencing valve of the present invention provides improved operational and torque characteristics during the swinging movement of the swing tower and boom by directing hydraulic fluid to the hydraulic motors in the following way.

As the swing tower of the backhoe starts to be moved from one extreme position in its arc of travel toward the other, one of the hydraulic motors is ported to provide the primary torque or motive force to the swing tower, while the other hydraulic motor, is ported to provide supplementary or additional torque. Because this second motor is in its overcenter condition when the swing tower is positioned at the end of its travel, this motor is less than fully extended. As the swing tower is rotated from the end of its travel, this second hydraulic motor first extends or expands until it is fully extended, this condition taking place as the longitudinal centerline or axis of the hydraulic motor intersects and passes through the vertical axis of the swing tower. The point of intersection represents the "center" position of that hydraulic motor.

So that the motor which is in its overcenter condition may supply additional torque to the swing tower as it is moved from the end of its arc of travel, the swing mechanism of the present invention directs pressurized hydraulic fluid to both sides of the piston of that hydraulic motor. Because the effective area against which the pressurized hydraulic fluid acts is greater on the cylinder or head end of the hydraulic motor than the area of the piston rod end of the hydraulic motor, a supplementary torque is applied to the swing tower by this motor as it moves out of its overcenter condition. The other hydraulic motor, which is not in an overcenter condition and is extending from its fully contracted position, provides the primary torque or motive force for pivoting the swing tower away from the end of its arc of travel. In this way, the motor providing the primary torque does not work to overcome the negative torque of the overcenter motor as in conventionally ported systems.

As the swing tower rotates, the sequencing mechanism continually rotates the valve spool of the rotary sequencing valve. This results in redirection of hydraulic fluid to the hydraulic motors as the hydraulic motor supplying the supplementary torque moves through its center position. In essence, this redirection of the hydraulic fluid is such that the pressurized fluid is supplied to opposite ends of the hydraulic motors, neither of which is then overcenter, which respectively expand and contract to move the swing tower through the central portion of its arc of travel.

As the swing tower and boom of the backhoe continue to rotate, the other of the hydraulic motors approaches its overcenter configuration. As this motor moves through its center position and goes overcenter, the rotation of the rotary valve spool by the sequencing mechanism again results in reporting of fluid to the hydraulic motors. The repositioning of the sequencing valve as one of the motors moves into its overcenter condition redirects the hydraulic fluid such that only the other (non-overcenter) motor applies motive force to the swing tower. Significantly, the cylinder ends of the motors are in fluid communication through the rotary sequencing valve as either motor goes overcenter. This arrangement provides the desired improvement in the torque characteristics of the swing mechanism, and also greatly facilitates hydraulic cushioning of the mechanism.

In order to prevent excessive shock to the frame, swing tower and boom, and hydraulic system of the backhoe, the present invention provides a hydraulic cushioning circuit operatively associated with the rotary sequencing valve. In the preferred embodiment, the cushioning circuit is incorporated into the body of the sequencing valve, but various arrangements may be used. This circuit is arranged such that the flow of hydraulic fluid which is being discharged from both of the hydraulic motors as the swing tower and boom move through an end portion of their arc of travel and approach the end of the arc is directed over a flow restricting orifice and a flow restricting relief valve disposed in a parallel flow relation. The cushioning circuit is arranged so that hydraulic cushioning is effected only during rotation of the boom through the ends of its arc of travel toward the travel stops.

A one way check valve is provided in the cushioning circuit so that reverse fluid flow through the circuit to the motors is substantially unrestricted and substantially bypasses the orifice and relief valve. Thus, the swing tower and boom may be moved away from the ends of their arc of travel without excessive hydraulic restriction or back pressure. This is significant in that it prevents excessive restriction when the operator of the backhoe is attempting to accelerate the swinging movement of the swing tower and boom. This cushioning circuit is an improvement over currently used designs in that it is no longer necessary to provide each hydraulic motor with a restricting orifice and "stinger" as is commonly done in current practice. Additionally, since flow from both motors is restricted to provide cushioning, the peak cushioning back pressure created is less than the peak pressure created in a conventional system in which flow from only one of the motors is restricted to effect cushioning of the boom assembly.

Thus, the present invention provides an improved hydraulic valving arrangement for the swing mechanism of a backhoe, or other suitable implement, which improves the operational characteristics of the hydraulic operation of the implement and provides necessary hydraulic cushioning for preservation of the system's components only when desirable.

DESCRIPTION OF THE PREFERRED EMBODIMENT

Figure 1:
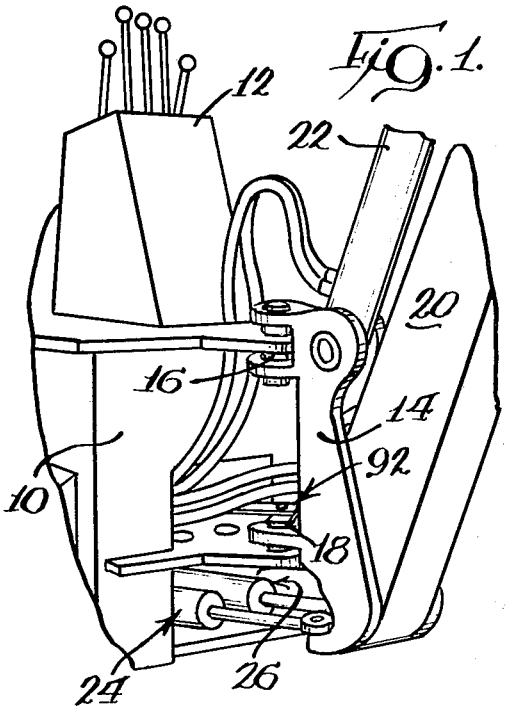
FIG. 1 is a partial perspective view of a backhoe showing the control area, boom and swing tower, and swing mechanism.

While the present invention is susceptible to embodiment in different forms, there is shown in the drawings and will hereinafter be described a preferred embodiment with the understanding that the present disclosure is to be considered as an exemplification of the principles of the invention and is not intended to limit the invention to the embodiment illustrated.

With reference now to FIG. 1 and FIGS. 3A–3C, therein is illustrated a portion of an articulated backhoe. The backhoe includes a frame 10 which is suitably supported on a tractor or other similar piece of equipment (not shown). The backhoe includes a control area 12 where an operator manipulates controls for articulation of the backhoe. Attached to the frame 10 is a mast or swing tower 14 which is pivoted for movement with respect to the frame 10 about a vertical pivot axis defined by upper pivot 16 and lower pivot 18. The swing tower 14 supports backhoe boom 20, which is movable about a horizontal axis with respect to the swing tower 14 by a double acting hydraulic motor or fluid ram 22.

Movement of the swing tower (and the boom) with respect to the frame 10 is provided by a pair of double acting hydraulic motors 24 and 26. Each of the hydraulic motors 24 and 26 respectively include a cylinder, 28 and 30, and a piston, 32 and 34, movable within the cylinder in response to pressurization by hydraulic fluid. Each of the hydraulic motors 24 and 26 are mounted to the frame 10 of the backhoe by cylinder pivots 36 and 38, respectively. The pistons 32 and 34 of hydraulic motors 24 and 26 are respectively pivotally interconnected with the swing tower 14 of the backhoe, whereby rectilinear motion of the piston rods within the cylinders of the hydraulic motors 24 and 26 provides rotation of the swing tower 14 about its vertical pivot axis defined by upper and lower pivots 16 and 18.

Figure 3A:
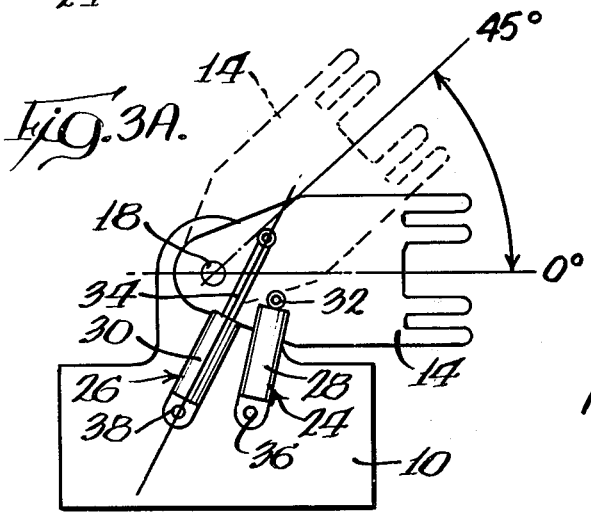
FIGS. 3A–3C illustrate the orientation of the swing mechanism hydraulic motors as the swing tower is moved from one end of its arc of travel to the other.
Figure 3B:
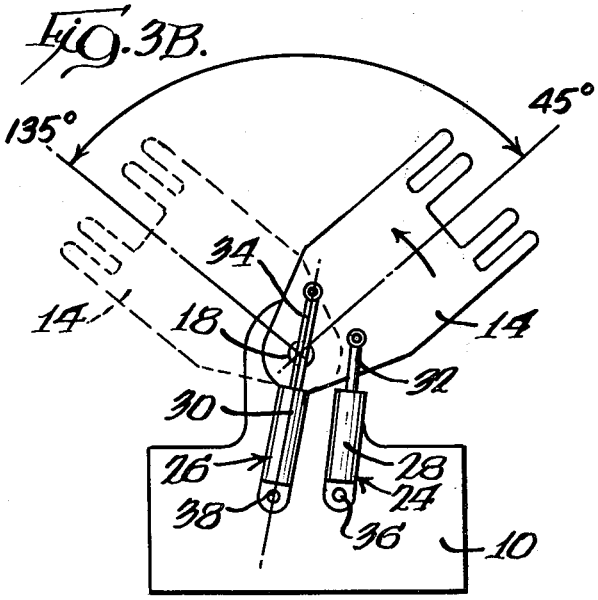
Figure 3C:
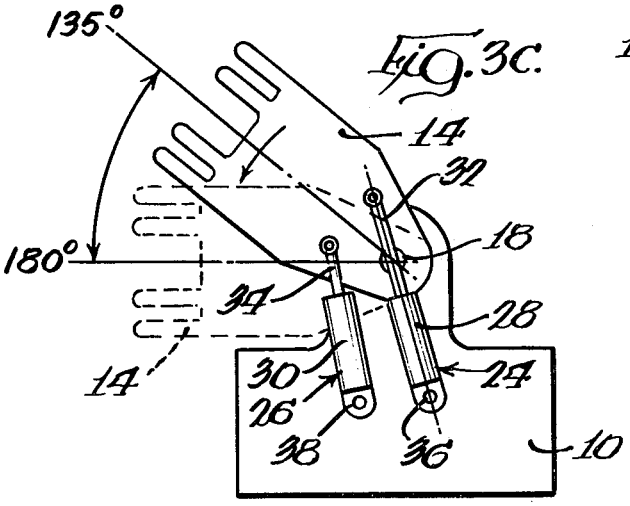

With further reference to FIGS. 3A–3C, the orientation of the hydraulic motors 24 and 26 with respect to the frame 10 and the swing tower 14 is illustrated as the swing tower 14 is pivoted through its arc of travel. As shown, this arc of travel is approximately 180 degrees, although it will be understood by those familiar with the art that the arc of travel may be greater than or less than this. Pressurized hydraulic fluid supplied to the hydraulic motors 24 and 26 provide expansion and contraction of the hydraulic motors such that the swing tower 14 is moved about its vertical swinging axis (this axis extending vertically through pivot 18 shown in FIGS. 3A–3C).

It will be understood that when either of the longitudinal centerlines of the hydraulic motors 24 and 26 intersect the vertical pivot axis of the swing tower 14, that motor is fully extended. This configuration is commonly referred to as the center position for that hydraulic motor. If the swing tower 14 and the boom 20 move from the central portion of their arc of travel toward either of the ends of the arc, one of the hydraulic motors 24 and 26 goes through its center position. As the swing tower 14 continues to be rotated, the hydraulic motor which has moved through its center position will then begin to contract, and that hydraulic motor will then be in its overcenter condition or configuration.

Significantly, as one of the hydraulic motors moves to and through its center position, the torque exerted by that hydraulic motor on the swing tower 14 approaches zero, and it would then apply a negative torque to the swing tower as it goes overcenter if the porting of pressurized hydraulic fluid to that hydraulic motor is not altered. Because the moment arm through which the other (non-overcenter) hydraulic motor reacts on the swing tower 14 is greater than the moment arm through which the overcenter hydraulic motor acts upon the swing tower 14, the negative torque would be overcome and the swing tower 14 and the boom 20 would continue to rotate. Clearly, it is desirable for the porting of the overcenter hydraulic motor to be altered so that, in essence, the hydraulic motors are not working against each other.

Additionally, the characteristics of the torque applied to the swing tower 14 are further improved if the hydraulic motor which is in its overcenter condition is ported to provide supplementary torque for rotating the swing tower 14 and the boom 20 as they move away from the end of their arc of travel, thereby improving the control and efficiency with which the boom 20 is rotated.

As shown in FIG. 3A, the swing tower 14 is illustrated as being at one end of its arc of travel. In this position, hydraulic motor 24 is shown as being fully contracted, and provides the primary motive force for rotating the swing tower 14 (and the boom 20, not shown) when pressurized hydraulic fluid is ported to the cylinder end thereof. Hydraulic motor 26 is shown in its overcenter condition.

As the swing tower 14 is counterclockwise rotated to the position shown in phantom in FIG. 3A, hydraulic motor 26 extends until it reaches its center position wherein its longitudinal centerline intersects the vertical swinging axis of the swing tower 14.

With reference now to FIG. 3B, the swing tower 14 is shown being moved through the central part of its arc of travel, approximately 90 degrees. The hydraulic motor 26 moves through its center position, as shown, and then begins to contract as hydraulic motor 24 continues to extend. Opposite ends of the hydraulic motors 24 and 26 are supplied with hydraulic fluid under pressure, with each contributing motive power for the rotation of the swing tower 14 and the boom 20.

As the swing tower 14 is further rotated to the position illustrated in FIG. 3C, it will be observed that hydraulic motor 24 moves into its center, fully extended position as its longitudinal centerline passes through the vertical swinging axis of swing tower 14. Further rotation of swing tower 14 to the position shown in phantom in FIG. 3C causes hydraulic motor 24 to go into its overcenter condition, wherein it is less than fully extended.

Thus, it will be appreciated that the hydraulic motors 24 and 26 go through three distinct operational phases as the swing tower 14 is rotated from one extreme of its arc of travel to the other. In the first phase, one hydraulic motor 24 provides the primary motive force for applying torque to the swing tower 14, and the other hydraulic motor 26 is in its overcenter condition (as in FIG. 3A). In the second phase (as in FIG. 3B) neither of the hydraulic motors 24 and 26 is in its overcenter condition, and each apply force to the swing tower 14 for moving the swing tower 14 and the boom 20. In the third phase (as in FIG. 3C) the one hydraulic motor 24 moves into its overcenter condition, while the other hydraulic motor 26 provides the motive force for the rotation of the swing tower 14. The hydraulic fluid flow and porting provided by the present invention will hereinafter be described with respect to each of these operational phases as the swing tower and boom are rotated.

Figure 2:
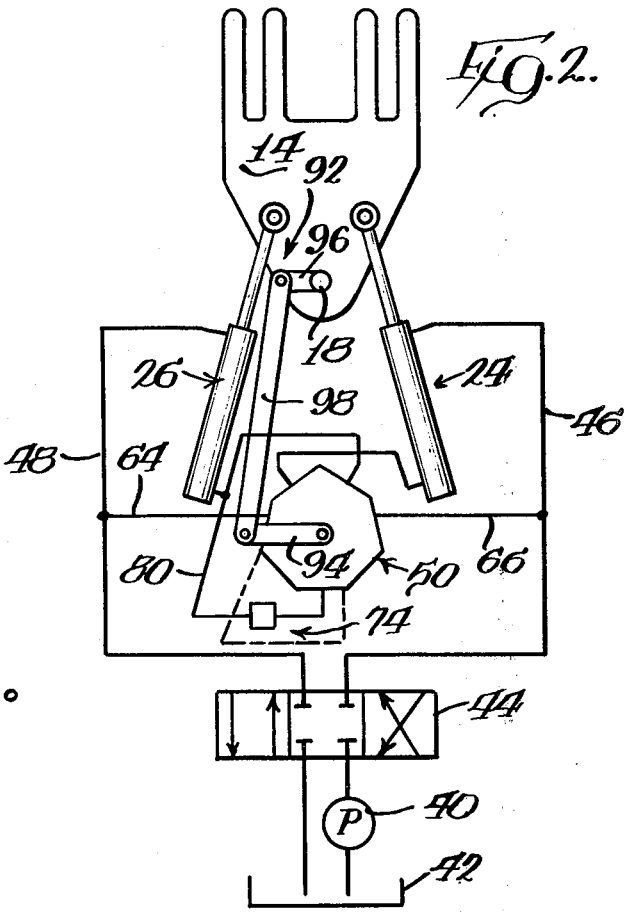
FIG. 2 is a diagrammatic view of the sequencing mechanism and hydraulic control circuit of the present invention shown in conjunction with the backhoe illustrated in FIG. 1.

Accordingly, FIG. 2 illustrates the hydraulic porting arrangement and sequencing mechanism for supplying hydraulic fluid to each of the hydraulic motors 24 and 26. The hydraulic system includes a pump (P) 40, usually mounted on the tractor or frame 10, which delivers hydraulic fluid under pressure from a fluid reservoir or sump 42. The hydraulic pump 40 delivers pressurized hydraulic fluid to a directional flow control valve 44 operatively connected with a control mechanism through which the operator of the backhoe may direct the flow of hydraulic fluid to the hydraulic motors 24 and 26. The control valve 44 includes two outlets which are respectively connected with the piston rod ends of hydraulic motors 24 and 26 by conduits 46 and 48.

The hydraulic system further includes rotary sequencing valve 50. As shown in FIGS. 4–8, the sequencing valve 50 includes a valve housing 52 which defines therein a bore 53.

Valve housing 52 further defines a plurality of fluid flow valve passages which are in fluid flow communication with bore 53.

First and fourth flow passages 54 and 60 are respectively in fluid communication with the piston rod ends of hydraulic motors 26 and 24 via conduits 64 and 66 joined to conduits 48 and 46. Second and third flow passages 56 and 58 are respectively in fluid communication with the cylinder ends of motors 24 and 26 by conduits 68 and 70.

Rotary sequencing valve 50 is hydraulically joined with a flow restricting hydraulic cushioning circuit 74 by a conduit 72 providing fluid flow communication between a fifth valve flow passage 62 and the circuit 74. The cushioning circuit 74 includes, arranged in parallel flow relation, a flow restricting, pressure responsive relief valve 76 (including an orifice), a flow restricting orifice 77, and a one-way flow check valve 78.

The other side of cushioning circuit 74 is in fluid communication with the cylinder end of one of motors 24 and 26 via conduit 80. Conduit 80 is shown connected with motor 26 via conduit 70, but could instead be joined with the cylinder end of motor 21 via conduit 68, since the cylinder ends of the motors are selectively placed in fluid communication during operation of rotary valve 50, thus providing mutual communication of the cylinder ends with circuit 74 under certain conditions. Preferably, circuit 74 is disposed within rotary valve housing 52, as indicated by phantom line in FIG. 2.

Rotary sequencing valve 50 includes a valve spool 82 rotatably disposed within bore 53 of valve housing 52. Valve spool 82 includes a plurality of axially extending lands 84 which define a plurality of recessed areas, specifically, first, second, and third recessed areas 86, 88, and 90. As will be described, rotation of valve spool 82 within valve housing 52 effects redirection of fluid flow through the flow passages in the housing by providing selective flow communication between the passages. If desired, lands 84 may be provided with metering grooves, or a similar arrangement to provide periods of transition between different operational modes of value 50.

An arrangement for repositioning the valve spool 52 within valve housing 52 is provided by sequencing mechanism 92, illustrated in FIG. 2. Mechanism 92 operatively connects swing tower 14 with valve spool 82 for concurrent, proportional rotation. Mechanism 92 is straightforward and uncomplicated in construction, including a spool arm 94 for rotating spool 82, a tower arm 96 which rotates with swing tower 14, and a connecting link 98 pivotally interconnecting arms 94 and 96. The ratio of the relative rotation of swing tower 14 and rotary valve spool 82 depends upon the relative lengths of arms 94 and 96. While the exact relationship is a matter of design choice, the arrangement shown provides approximately 110° of rotation of spool 82 as swing tower 14 rotates approximately 180°.

It will be appreciated that this arrangement of rotary sequencing valve 50 and sequencing mechanism 92 is an improvement upon mechanisms heretofore known for effecting hydraulic fluid porting as swing tower 14 is rotated. The need for cams and cam followers, overtravel mechanisms, or electrical switching devices is eliminated by the simple, operative interconnection of the rotating swing tower with the valve spool 82 of the rotary valve. This arrangement provides the desired redirection of hydraulic fluid to motors 24 and 26 in an efficient fashion. Preferably, redirection of fluid is effected generally as either motor moves through its center position so the flow of pressurized hydraulic fluid to the motors may be altered as the swing mechanism moves through its different operational phases. However, it will be understood that the portions of the arc of travel of the swing tower 14 and the boom 20 during which the rotary sequencing valve 50 redirects hydraulic fluid is a matter of design choice depending upon the exact nature and components of the system used and the desired operational characteristics.

OPERATION

The operation of the hydraulic system of the present invention and the improved operational characteristics achieved thereby will now be discussed in detail.

With reference to FIGS. 4–8, the operation of the hydraulic motors 24 and 26 by the hydraulic system of the invention will be described as the swing tower and boom are rotated counterclockwise from their extreme right-hand position (see FIG. 3A) to their extreme left-hand position (see FIG. 3C, phantom).

Figure 4:
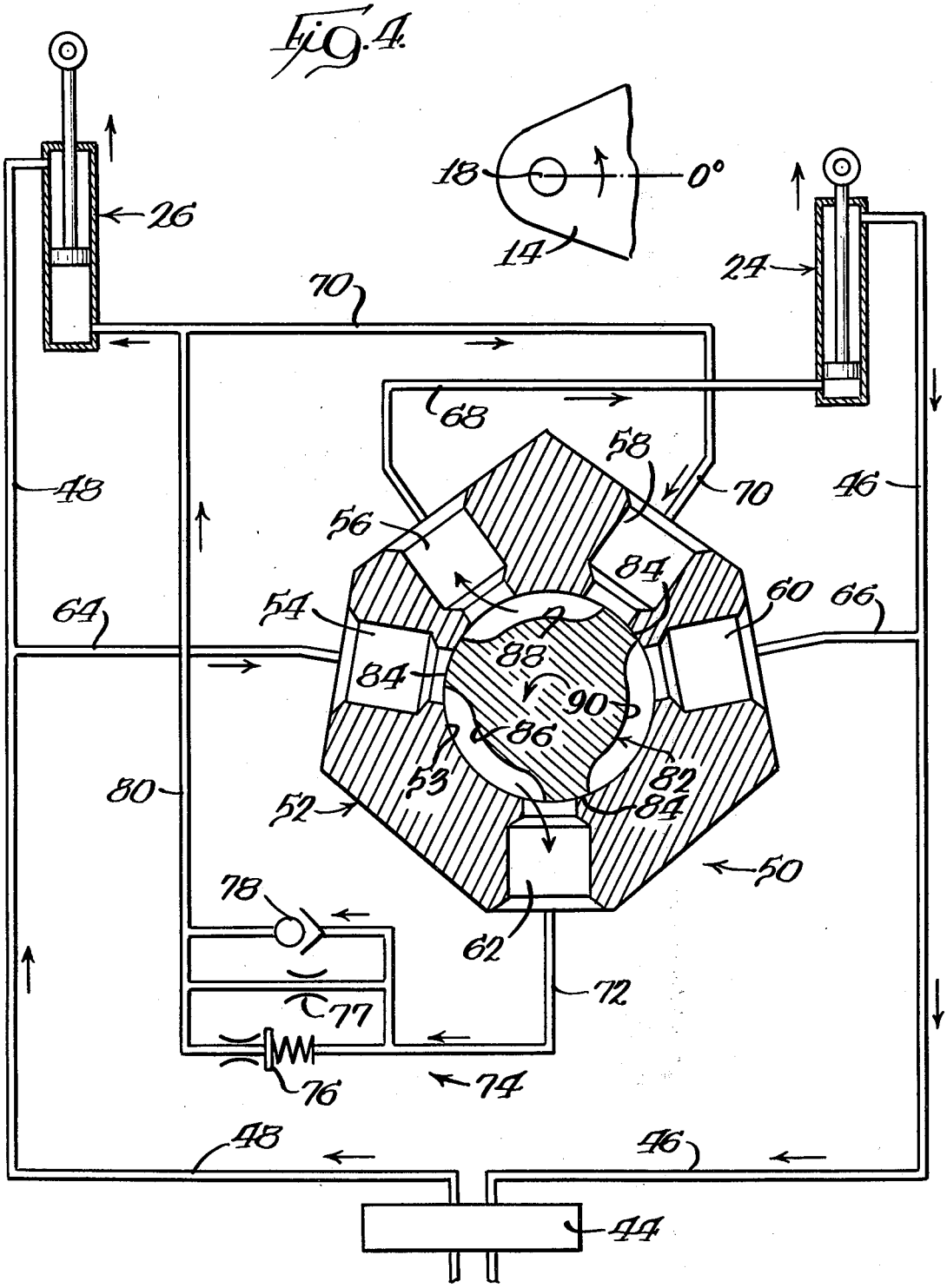
FIGS. 4–8 are diagrammatic cutaway views illustrating the operation of the hydraulic sequencing arrangement of the present invention as the hydraulic motors of the backhoe pivot the swing tower of the backhoe from its extreme right-hand to extreme left-hand positions.

With particular reference to FIG. 4, the arrangement of the hydraulic system is illustrated for moving the swing tower 14 counterclockwise away from the end of its arc of travel. In this position, hydraulic motor 24 provides the primary force for rotating the swing tower 14 and the boom 20 (by supply of fluid under pressure to the cylinder end of motor 24), while the hydraulic motor 26 is in its overcenter condition.

As discussed, it is desirable to provide supplementary torque to the swing tower 14 so that hydraulic motor 24 may be assisted in starting the rotation of the swing tower and boom. This is accomplished by pressurizing both sides of hydraulic motor 26, since the area of the piston on the cylinder end of the hydraulic motor 26 is greater than the area of the piston on the piston end of that motor.

Porting in this manner is accomplished by positioning of valve spool 82 of the rotary sequencing valve 50 as shown in FIG. 4. Arrows indicate the direction of flow of hydraulic fluid within the system. As shown, high pressure fluid is delivered to the system from the control valve 44 through conduit 48. Hydraulic fluid supplied to conduit 48 pressurizes the piston rod end of motor 26, and flows into flow passage 54 in valve housing 52 through conduit 64. Because of the positioning of valve spool 82 within valve housing 52, flow passages 54 and 62 are in fluid flow communication across recessed area 86. Thus, pressurized hydraulic fluid flow from flow passage 62 into conduit 72, and flows into hydraulic cushioning circuit 74. Fluid flow bypasses relief valve 76 and flows through the check valve 78. Flow through orifice 77 is negligible. In this way, check valve 78 permits substantially unrestricted fluid flow through the cushioning circuit to the hydraulic motors.

Pressurized fluid from cushioning circuit 74 flows through conduit 80 to conduit 70. Pressurized flow is thus provided to the cylinder end of motor 26, and also enters rotary sequencing valve 50 through flow passage 58. Flow passages 58 and 56 are in flow communication across recessed area 88 of valve spool 82 in this position of the valve spool. Flow from passage 56 enters conduit 68 to the cylinder end of motor 24 so that pressurized hydraulic fluid is supplied to the cylinder ends of both of the hydraulic motors 24 and 26. As positioned in FIG. 4, rotary valve 50 provides, in essence, flow communication between the cylinder ends of motors 24 and 26, and between the piston rod end and cylinder end of motor 26 across circuit 74.

The piston rod end of the hydraulic motor 24 is in flow communication through conduit 46 with the control valve 44 to the reservoir of the hydraulic system. It should be noted that although high pressure fluid has been provided within conduit 48 connected with the piston end of hydraulic motor 26, flow of fluid within conduit 48 is away from the piston rod end of motor 26, since motor 24, providing the primary motive force to swing tower 14, pivots the swing tower and boom counterclockwise, resulting in extension of motor 26. Thus, hydraulic motor 24 provides the primary force for rotating the swing tower 14 away from the end of its arc of travel, while hydraulic motor 26 supplies supplementary force to the swing tower 14. Because hydraulic motor 26 is in its overcenter condition as illustrated in FIG. 4, both of the piston rods of the hydraulic motors 24 and 26 will move outwardly as indicated by the arrows.

Thus, as the piston rod end of motor 26 is pressurized through conduit 48, rotary sequencing valve 50 directs pressurized fluid to the cylinder ends of the motors. Fluid communication via rotary valve 50 between the cylinder ends, and between the piston rod end and cylinder ends of motor 26 across cushioning circuit 74 provides this result.

Figure 5:
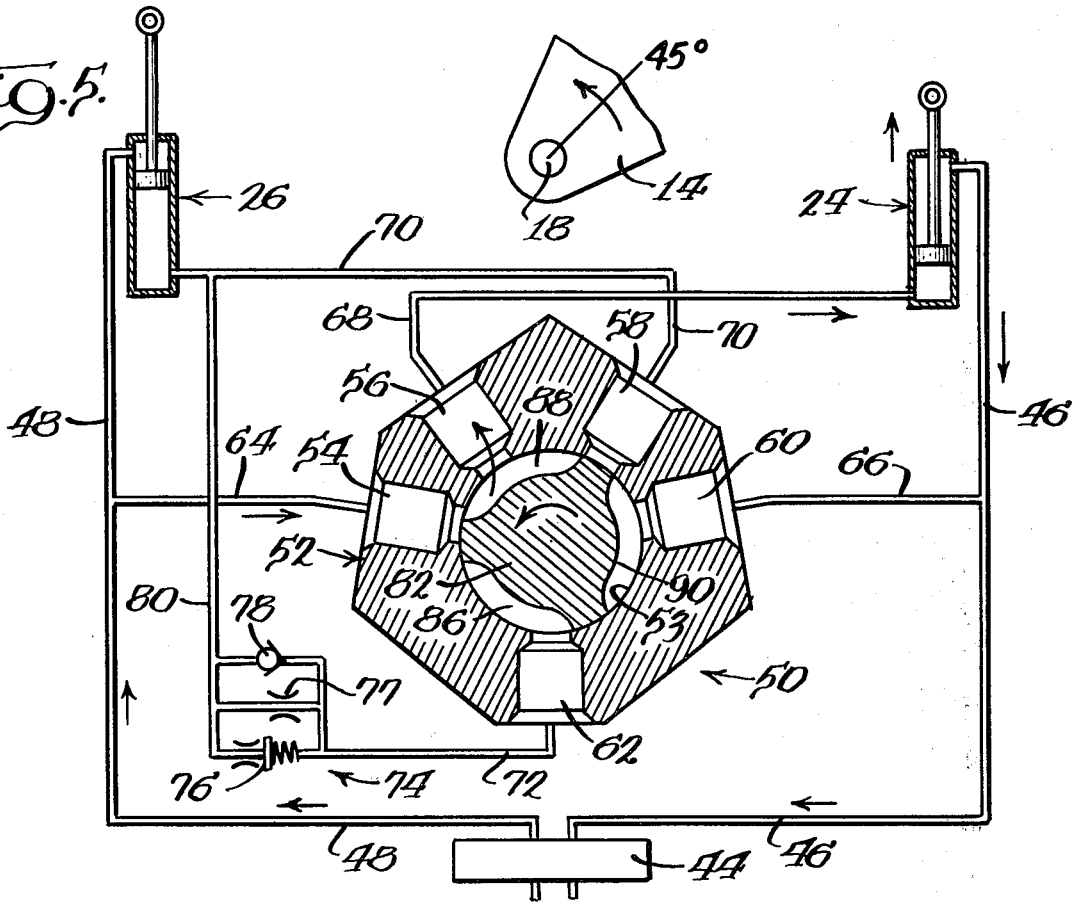

With reference now to FIG. 5, the hydraulic system and hydraulic motors 24 and 26 are illustrated as the swing tower 14 is moved toward the central portion of its arc of travel, and motor 26 is moved through its center (fully extended) position. As the swing tower is rotated, valve spool 82 of rotary valve 50 is correspondingly rotated to redirect the flow of fluid to the motors, and is positioned generally as shown in FIG. 5. In this position, high pressure fluid supplied to conduit 48 from valve 44 flows through conduit 64 to flow passage 54. Flow passage 54 is in fluid flow communication with flow passage 56 across recessed portion 88 of valve spool 82, and thus pressurized fluid is supplied to the cylinder end of motor 24 through conduit 68. The piston rod end of motor 24 is ported to the low pressure (reservoir) side of the hydraulic system through conduit 46 and control valve 44. This motor continues to rotate swing tower 14 as motor 26 is moved through its center position from its overcenter position.

Figure 6:
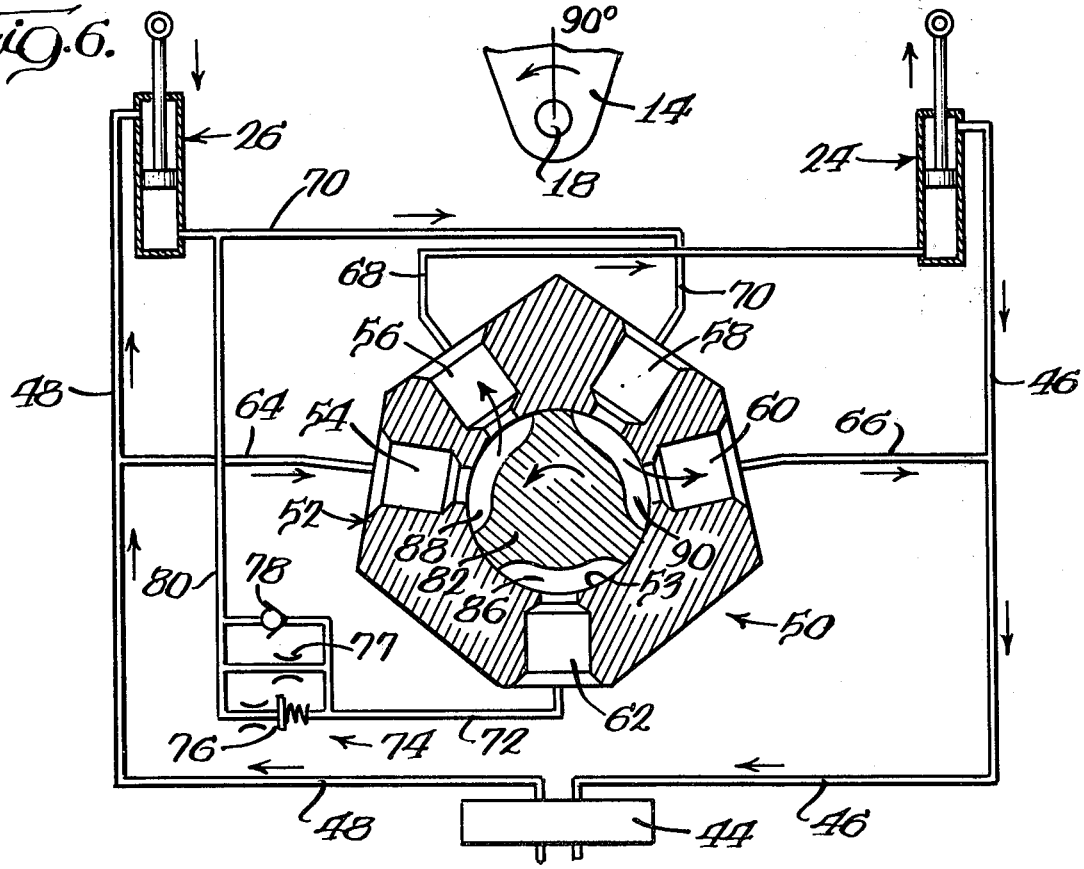

With reference now to FIG. 6, the hydraulic system and hydraulic motors 24 and 26 are illustrated after motor 26 has moved out of its overcenter position and swing tower 14 is being moved through the central portion of its arc of travel. This central range of motion is illustrated in FIG. 3B. During movement of the swing tower 14 through this portion of the arc of travel, each of the hydraulic motors 24 and 26 is in a non-overcenter condition, with hydraulic motor 26 contracting while hydraulic motor 24 is extending.

As hydraulic motor 26 moves past its center position (see FIG. 3B), the continuing rotation of valve spool 82 by sequencing mechanism 92 redirects hydraulic fluid flow to the motors. In the configuration of the rotary valve shown in FIG. 6, pressurized hydraulic fluid is supplied to opposite ends of motors 24 and 26. Rotary valve 50 provides fluid communication between the piston rod end of motor 26 and the cylinder end of motor 24, and between the cylinder end of motor 26 and the piston rod end of motor 24.

Pressurized fluid is supplied to conduit 48, and flow passage 54 through conduit 64. The conduit 48 supplies pressurized fluid to the piston rod end of hydraulic motor 26, while pressurized fluid directed to flow passage 54 flows across recessed portion 88 of the valve spool 82, and out of valve passage 56 through conduit 68 to the cylinder end of hydraulic motor 24.

The cylinder end of hydraulic motor 26 is in flow communication with flow passage 58 through conduit 70. Flow passage 58 is in communication with flow passage 60 across recessed area 90 of the valve spool, and thus with the reservior of the hydraulic system through conduits 66 and 46, and control valve 44. The piston rod end of hydraulic motor 24 also communicates with the fluid reservior through conduit 46. Thus, the swing tower and boom of the backhoe are swung about their vertical axis as hydraulic motor 26 contracts and hydraulic motor 24 expands by the supply of pressurized fluid to the piston rod end of motor 26 from the control valve 44, and the direction of pressurized fluid to the cylinder end of motor 24 by rotary sequencing valve 50. It will be observed that there is no flow through hydraulic cushioning circuit 74 in this position of valve spool 82 since the fluid restricting effect provided by the circut is not required during movement of the swing tower and boom through the central portion of their arc of travel.

Figure 7:
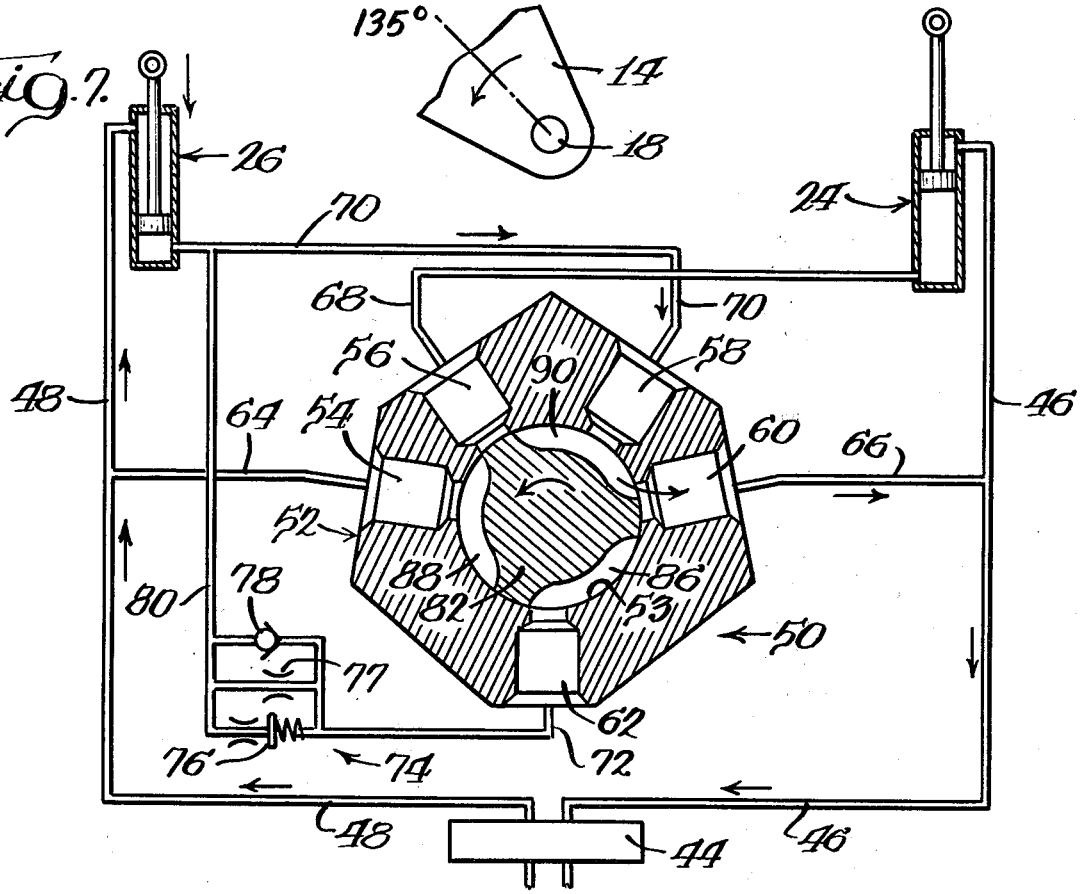

As shown in FIG. 7, the hydraulic system and motors 24 and 26 are illustrated as motor 24 passes through its center (fully extended) position (See FIG. 3B, phantom). Continuing rotation of valve spool 82 by swing tower 14 positions the valve spool so that motor 26 continues to rotate the swing tower as motor 24 moves through its center position. High pressure hydraulic fluid is supplied to the piston rod end of motor 26 through conduit 48. Fluid flow from the cylinder end of motor 26 passes through conduit 70 to flow passage 58, from flow passage 58 to flow passage 60 across recessed area 90 of valve spool 82, and from flow passage 60 to the fluid reservior of the system via conduits 66 and 46. In this position of valve spool 82, no fluid flows through cushioning circuit 74.

Figure 8:
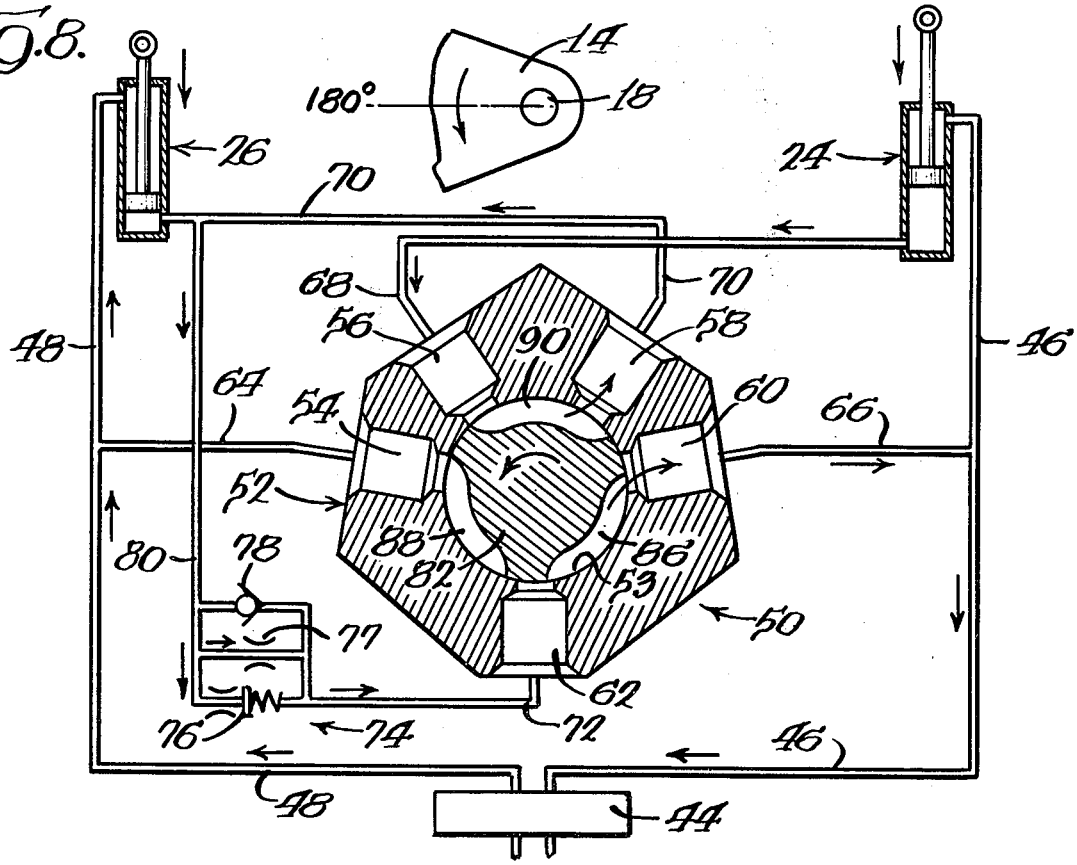

With reference now to FIG. 8, the hydraulic system is illustrated after hydraulic motor 24 has passed through its center position and has gone overcenter (see FIG. 3C), and thus both motors 24 and 26 are contracting. During swinging movement of the swing tower and boom through the end portion of their arc of travel toward their travel stop, hydraulic cushioning is required to prevent excessive shock loading of the backhoe frame, boom and swing tower and hydraulic system.

As the hydraulic motor 24 moves from its center position and begins to contract as it goes overcenter, sequencing linkage 92 moves the valve spool 82 toward the position shown in FIG. 8. As rotary valve 50 is moved toward this position, pressurized hydraulic fluid is supplied to the piston rod end of hydraulic motor 26 only, while hydraulic cushioning for the swing mechanism is provided by directing the flow from the cylinder ends of both of the hydraulic motors 24 and 26 to the hydraulic cushioning circuit 74 provided to restrict the flow from the motors.

Since it is desirable to permit relatively unrestricted movement of the boom assembly until hydraulic cushioning is required as the swing tower and boom approach their travel stop, cushioning is preferably effected somewhat after motor 24 goes overcenter so movement of the boom assembly is not unnecessarily restricted. For example, cushioning may be effected during the final 30 to 35 degrees of rotation of the swing tower and boom toward their travel stop. Of course, the exact timing of hydraulic cushioning is a matter of design choice, in part dependent upon the inertial characteristics of the boom assembly.

As shown in FIG. 8, pressurized hydraulic fluid is supplied through conduit 48 to the piston rod end of hydraulic motor 26. The cylinder end of motor 26 is in communication with cushioning circuit 74 through conduit 80. Since the cylinder end of motor 24 (which has gone overcenter) is in flow communication with the cylinder end of motor 26 through conduit 68, flow passages 56 and 58 across recessed area 90 of valve spool 82, and through conduit 70, the cylinder end of motor 24 is also in communication with circuit 74. Thus, fluid flowing from the cylinder ends of hydraulic motors 24 and 26 is directed to conduit 80 and the hydraulic cushioning circuit 74.

Fluid flow into circuit 74 initially flows through orifice 77, which restricts flow so that cushioning back pressure is created in the circuit. As back pressure in the cushioning circuit increases and reaches a predetermined value, on the order of 800 pounds per square inch (psi) for example, relief valve 76 opens to permit flow therethrough. Because relief valve 76 includes an orifice in series, a further increase in fluid flow through the cushioning circuit results in the orifice of valve 76 restricting flow to further increase the cushioning back pressure of the circuit. For example, circuit 74 may be designed to create cushioning back pressure as high as 3000–3500 psi in order to adequately cushion the movement of the backhoe swing tower and boom toward their travel stop.

It will be appreciated the peak cushioning back pressure within circuit 74 is less than the back pressure typically needed to cushion swinging movement of a boom assembly in which flow from only one of its swing motors is restricted, since the present system effects cushioning by restricting flow from both motors 24 and 26. Clearly, this is a significant improvement over previously known arrangements.

Notably, orifice 77 permits fluid flow through circuit 74 when volumetric fluid through the circuit is insufficient to cause relief valve 76 to open, as may be the case under some conditions. For instance, when the backhoe operator stops the movement of the boom before it reaches its travel stop, and then continues to move the boom to the stop, fluid flow into cushioning circuit 74 may be insufficient to raise the back pressure over orifice 77 to open relief valve 76. Orifice 77 thus permits flow through the circuit under these conditions.

In order to accommodate use of different implements on the backhoe boom, it may be desirable to "fine tune" the cushioning effect of cushioning circuit 74. For example, orifice 77 may be replaced with an orifice of a different size, as may be the orifice of relief valve 76, or the relief valve 76 provided may be of an adjustable nature so the cushioning characteristics of circuit 74 may be readily altered.

While the provision of an orifice and an orificed relief valve in parallel with a check valve is the preferred arrangement for cushioning circuit 74, it will be appreciated that many of the desirable operational characteristics of the present system may be achieved by providing an orifice or equivalent flow restrictor in parallel with a check valve, without a pressure responsive relief valve.

Flow from cushioning circuit 74 is directed through conduit 72, through flow passages 62 and 66 across recessed area 86 of valve spool 82. The hydraulic fluid then flows to the reservoir of the hydraulic system via conduits 66 and 46. It will be appreciated that in this last mode of operation, rotary valve 50 provides fluid communication between the cylinder ends of motors 24 and 26, and between the cylinder ends and the piston rod end of motor 24 across cushioning circuit 74.

It should be noted that as shown in FIG. 8, hydraulic fluid is flowing into the piston rod end of hydraulic motor 24 (since this motor is in its overcenter condition and its piston rod is moving inwardly as hydraulic motor 26 rotates the swing tower and boom), although there is essentially no motive force applied to the swing tower by the hydraulic motor 24 as the swing tower and boom are moved to the end of their arc of travel. Rather, motor 26 cushions the movement of the swing tower and boom since fluid flow from its cylinder end, together with flow from the cylinder end of motor 24, is restricted by cushioning circuit 74.

Thus, the hydraulic swing system goes through its three operational phases as swing tower 14 is rotated from right to left through its full range of travel. As pressurized hydraulic fluid is supplied to the piston rod end of motor 26 from control valve 44, the rotary sequencing valve 50 first sequentially supplies pressurized fluid: first to both cylinder ends of motor 24 and 26 (FIG. 4), then to the cylinder end of motor 24 only (FIG. 6), and finally to neither of the cylinder ends of motors 24 and 26 (FIG. 8). As the swing tower and boom approach their travel stop, fluid flow from the cylinder ends of the motors is restricted by direction through cushioning circuit 74.

While the above-described operation has been for rotation of swing tower 14 and boom 20 from their extreme right-hand to extreme left-hand positions, it will be appreciated that rotation in the opposite direction is effected in an essentially similar fashion.

Directional control valve 44 is positioned so that pressurized hydraulic fluid is ported to conduit 46, and conduit 48 is ported to the hydraulic fluid reservoir of the system. In rotating the swing tower clockwise from extreme left to extreme right, pressurized hydraulic fluid is supplied to the piston rod end of motor 24 from control valve 44. Concurrently, rotation of rotary valve spool 82 by sequencing mechanism 92 results in the desired sequential porting of hydraulic fluid by sequencing rotary valve 50. Specifically, valve 50 first supplies pressurized fluid to both cylinder ends of motors 24 and 26, then to the cylinder end of motor 26 only, and finally to neither of the cylinder ends of motors 24 and 26. During a portion of this last operational phase when pressurized fluid is supplied to the piston rod end of motor 24 and neither of the cylinder ends of the motors, fluid flow from the cylinder ends of the motors is directed through cushioning circuit 74, thus providing the desired hydraulic cushioning as the swing tower and boom move through the end portion of their arc of travel toward the travel stop.

The advantages of the above-described system will be readily apparent to those familiar with the art. By providing a single hydraulic cushioning circuit which serves to cushion each of the hydraulic motors of the swing mechanism only during movement of the swing tower and boom of the backhoe toward the end of their arc of travel, a vastly improved and simplified swing mechanism hydraulic system is provided.

Among the distinct advantages of the present system over systems currently in use is the elimination of stingers and relief valves from the cylinders of each of the hydraulic motors. Clearly, this is advantageous in reducing both fabrication costs and maintenance expenses.

Additionally, the removal of the usual orifices from each of the hydraulic motors improves the efficiency of the system since the orifices restrict fluid flow and generate back pressure at undesired times, and act to increase the temperature of hydraulic fluid in the system. Further, the removal of the usual orifices from the hydraulic motors increases the acceleration and average top speed of the swing tower and boom assembly, particularly when the assembly is stopped then restrated with one of the hydraulic motors in an overcenter condition. Thus, swing time and energy loss are decreased, while productivity of the backhoe increased.

Further benefits of the present system relate to a decrease in peak cushioning pressures. Since substantially all cushioning is provided by restricting the fluid flow from only one hydraulic motor in a typical stinger-/orifice cushioning arrangement, the back pressure created is relatively high. In contract, the present system provides cushioning by restricting flow from the cylinder ends of both hydraulic motors, so peak back pressures are substantially reduced while the same amount of hydraulic cushioning may be provided. This is a significant improvement over previous arrangements, and greatly enhances the reliability of the entire swing mechanism.

The present invention hydraulic system further provides the operator of the backhoe with better stopping control as well as smoother stopping. Since a single cushioning circuit effects cushioning of both hydraulic motors at both ends of travel of the boom assembly, cushioning is consistent. In conventionl arrangements where orifices in the motors restrict flow from one motor or the other to effect cushioning, minor variations in the size and finish of the orifices in the motors can result in inconsistent cushioning from one end of travel of the boom assembly to the other. Additionally, the cushioning effect of the present system may be readily altered for adaptability of the system to various attachments which may be supported by the boom of the backhoe by changing the size of orifice 77, by adjusting relief valve 76 (if adjustable in nature), or by changing the size of the orifice of the relief valve.

The present invention further provides improved torque characteristics for the backhoe swing mechanism by the redirection of hydraulic fluid by rotary sequencing valve 50. The selective porting of fluid to motors 24 and 26 is effected in an efficient manner, with the simplified construction of sequencing valve 50 and sequencing mechanism 92 providing durability and ease of fabrication, and a distinct improvement over previously known arrangements.

A significant benefit of the improved torque characteristics of the present swing mechanism relates to the type of hydraulic motors which may be used in systems, and the degree of movement through which the backhoe boom assembly may be pivoted. In current arrangements, it has been typically necessary to employ trunnion-mounted hydraulic motors in order to achieve a range of swinging movement for the boom assembly through approximately 180 degrees. This is because end-mounted hydraulic motors, which are usually less costly to use, cannot be readily mounted to provide as wide a range of motion. When conventionally ported end-mounted motors are employed, the geometry of the system is usually such that the negative torque applied to the boom assembly when one of the motors is in its overcenter configuration cannot be sufficiently overcome by the non-overcenter motor to permit a range of motion in excess of approximately 160–170 degrees. Since the present swing mechanism obiates the problems heretofore associated with the application of this negative torque to the boom assembly, end-mounted hydraulic motors may be readily employed without detriment to the available range of pivoting movement of the boom assembly. This represents a distinct improvement upon previously known swing mechanisms.

Thus, the varied and significant advantages and features of the present hydraulic control system for a backhoe swing mechanism will be readily appreciated. The swing system of the present invention provides improved control of the swinging movement of the backhoe boom, and increases productivity of the machine. The reduction in the number of parts of the system, in comparison to conventional control and cushioning arrangements, significantly increases the reliability of the system, which is particularly important in view of the rugged and demanding use to which backhoes are typically subjected.

From the foregoing, it will be observed that numerous variations and modifications may be effected without departing from the true spirit and scope of the novel concept of the present invention. It will be understood that no limitation with respect to the specific apparatus illustrated herein is intended or should be inferred. It is, of course, intended to cover by the appended claims all such modifications as fall within the scope of the claims.

What is claimed is as follows:

1. In an implement having a frame attached to a tractor having a hydraulic system, and a swing tower pivotally connected to said frame about a vertical pivot axis and supporting a boom, an arrangement for pivoting said swing tower and said boom about said vertical axis through an arc of travel, comprising:

(a) two hydraulic motors pivotally interconnected between the frame and the swing tower, each of said motors having a cylinder end and a piston rod end, the extension and contraction of said motors pivoting said swing tower about its vertical pivot axis on the frame, each of said motors being fully extended when its respective centerline intersects said vertical axis;

(b) a hydraulic circuit connected to each motor by conduit means;

(c) directional flow control means, operatively connected to said conduit means, for selectively directing fluid under pressure from said hydraulic system to said two hydraulic motors;

(d) restricting means in said hydraulic circuit for restricting fluid flow from both of said motors during movement of said swing tower and said boom through end portions of their arc of travel prior to reaching the end of the arc, including rotary sequencing valve means hydraulically joined to said motors, said flow control means, and said restricting means, said sequencing valve means being operatively associated with the pivotal position of said swing tower whereby when said flow control means direct fluid to pressurize the piston rod end of one of said motors in pivoting said swing tower through said arc, said sequencing valve means sequentially provides fluid communication between:

said one piston rod end and both the cylinder ends across said restricting means;

said one piston rod end and the cylinder end of the other motor, and between the cylinder end of the one motor and the piston rod end of the other motor; and both the cylinder ends and the piston rod end of the other motor across said restricting means.

2. The apparatus as set forth in claim 1, wherein said restricting means comprises check valve means for providing substantially unrestricted flow to said motors.

3. In an implement having a frame attached to a tractor having a hydraulic system, and a swing tower pivotally connected to said frame about a vertical pivot axis and supporting a boom, an arrangement for pivoting said swing tower and said boom about said vertical axis through an arc of travel, comprising:

(a) two hydraulic motors pivotally interconnected between the frame and the swing tower, each of said motors having a cylinder end and a piston rod end, the extension and contraction of said motors pivoting said swing tower about its vertical pivot axis on the frame, each of said motors being fully extended when its respective centerline intersects said vertical axis;

(b) a hydraulic circuit connected to each motor by conduit means;

(c) directional flow control means, operatively connected to said conduit means, for selectively directing fluid under pressure from said hydraulic system to said two hydraulic motors;

(d) restricting means in said hydraulic circuit for restricting fluid flow from both of said motors during movement of said swing tower and said boom through end portions of their arc of travel prior to reaching the ends of the arc;

said hydraulic circuit includes rotary sequencing valve means hydraulically joined to said motors, said flow control means, and said restricting means, said sequencing valve means being operatively associated with the pivotal position of said swing tower such that when said swing tower and boom are pivoted from one end of said arc to the other and said flow control means directs fluid under pressure to pressurize the piston rod end of one of said motors, said sequencing valve means directs fluid under pressure sequentially: first to both of said cylinder ends, then to only the cylinder end of the other motor, and then to neither of said cylinder ends.

4. The apparatus as set forth in claim 3, wherein said rotary sequencing valve means redirects hydraulic fluid flow to the cylinder ends of said hydraulic motors: first generally when the centerline of said one hydraulic motor crosses the vertical axis of the swing tower, and then generally when the centerline of said other hydraulic motor crosses said vertical axis.

5. The apparatus as set forth in claim 3, wherein said rotary sequencing valve means includes:

(a) a valve housing having a bore;

(b) a rotary valve spool disposed within the bore of said valve housing for rotational movement therein, said spool and said valve housing cooperating to control the flow of fluid to and from the cylinder ends of said two hydraulic motors; and (c) sequencing means connected to said valve spool and operatively associated with the position of said swing tower for positioning said spool.

6. The apparatus as set forth in claim 5, wherein said valve housing has a plurality of flow ports passages communicating with said bore: two of said passages being in respective flow communication with the piston rod ends of said two hydraulic motors; another two of said passages being in respective flow communication with the cylinder ends of said two hydraulic motors; one of said passages in communication with one of the cylinder ends being in flow communication with said restricting means; and said valve spool includes a plurality of lands separating a plurality of recessed portions to provide selective flow communication between said flow passages.

7. The apparatus as set forth in claim 6, wherein said restricting means are disposed in flow communication between said one passage and another one of said flow passages in communication with said bore.

8. The apparatus as set forth in claim 6, wherein said restricting means includes flow restricting means and a one way check valve disposed in parallel flow relation, said check valve operating to permit substantially unrestricted fluid flow through said restricting means from said another one of said passages.

9. The apparatus as set forth in claim 8, wherein said flow restricting means comprise a flow restricting orifice and a pressure responsive relief valve disposed in parallel flow relation.

10. The apparatus as set forth in claims 5 or 9, wherein said sequencing means includes a linkage connecting said swing tower and said valve spool for proportional, concurrent rotation.

11. The apparatus as set forth in claim 6, wherein said rotary sequencing valve means operates to provide fluid communication between:

the piston rod end of said one motor and said restricting means across a first of said recessed areas, and between both the cylinder ends of said motors across a second of said recessed areas when said valve means directs fluid under pressure to both the cylinder ends;

the piston rod end of said one motor and the cylinder end of said other motor across said second recessed area, and the cylinder end of said one motor and the piston rod end of said other motor across a third of said recessed areas when said valve means directs fluid under pressure only to the cylinder end of the other motor; and the cylinder ends of both said motors across said third of recessed area, and the piston rod end of said other motor and said restricting means across said first recessed area when said valve means directs fluid under pressure to neither of said cylinder ends.

12. In an implement having a fixed member and a pivoting member that is pivotally connected to said fixed member for rotational movement about an axis, apparatus for rotating said pivoting member through an arc about said axis, comprising:

(a) at least two hydraulic motors pivotally interconnected between said fixed member and said pivoting member to rotate said pivoting member relative to said fixed member by extension and contraction of said motors, each of said hydraulic motors having a piston rod and a cylinder end, the center position of each motor defined as that position where the centerline of the hydraulic motor intersects said axis;

(b) fluid circuit means, connected to said two hydraulic motors, for selectively directing hydraulic fluid under pressure to actuate said hydraulic motors to rotate said pivoting member about said vertical axis, and (c) restricting means in said circuit means for restricting fluid flow from both of said motors when said pivoting member is moved through an end portion of said arc toward an end of said arc, said circuit means including rotary sequencing valve means operatively associated with said pivoting member whereby said circuit means sequentially ports fluid under pressure: first to both ends of one motor and to one end of the other motor; then both to said one end and to the other end of said one motor; and then only to said other end of said one motor, in rotating said pivoting member through said arc.

13. The apparatus as set forth in claim 12, wherein said rotary sequencing valve means includes a rotary valve having first, second, and third positions respectively corresponding to the sequential direction of fluid under pressure, and first, second, third, and fourth flow control passages, each passage being in respective fluid communication with one of the four ends of said two hydraulic motors, and a fifth flow control passage in fluid communication with said restricting means.

14. The apparatus as set forth in claim 13, wherein:

(a) the first passage and the fifth passage, and the second passage and the third passage, are in respective fluid communication with each other when said valve is in said first position;

(b) the first passage and the second passage, and the third passage and the fourth passage, are in respective fluid communication when said valve is in said second position; and (c) the second passage and the third passage, and the fourth passage and the fifth passage, are in respective fluid communication with each other when said valve is in said third position.

15. The apparatus as set forth in claim 14, wherein said first and third passages are in fluid communication with opposite ends of the one hydraulic motor, and said second and fourth passages are in fluid communication with opposite ends of the other hydraulic motor, and said restricting means is in fluid communication with one of said second and third passages, and said fifth passage.

16. The apparatus as set forth in claim 15, wherein said restricting means includes flow restricting means and a one-way check valve disposed in parallel flow relation, said check valve permitting substantially unrestricted flow from said fifth passage through said restricting means.

17. The apparatus as set forth in claims 13 or 16, wherein said sequencing valve means includes a linkage connecting said rotary valve with said pivoting member for concurrent, proportional rotation of said rotary valve with said pivoting member.

* * * * *